US009526942B2

(12) United States Patent
Mills et al.

(10) Patent No.: US 9,526,942 B2
(45) Date of Patent: Dec. 27, 2016

(54) EXERCISE DEVICE

(71) Applicant: Implus Footcare, LLC, Durham, NC (US)

(72) Inventors: Alden Morris Mills, Kentfield, CA (US); Ian Coats MacColl, Mill Valley, CA (US)

(73) Assignee: IMPLUS FOOTCARE LLC, Durham, NC (US)

( * ) Notice: Subject to any disclaimer, the term of this patent is extended or adjusted under 35 U.S.C. 154(b) by 175 days.

(21) Appl. No.: 14/084,015

(22) Filed: Nov. 19, 2013

(65) Prior Publication Data

US 2014/0141949 A1 May 22, 2014

Related U.S. Application Data

(60) Provisional application No. 61/728,305, filed on Nov. 20, 2012.

(51) Int. Cl.

| | |
|---|---|
| ***A63B 21/00*** | (2006.01) |
| ***A63B 23/12*** | (2006.01) |
| ***A63B 23/02*** | (2006.01) |

(52) U.S. Cl.

CPC ..... *A63B 21/1469* (2013.01); *A63B 21/00047* (2013.01); *A63B 21/1465* (2013.01); *A63B 21/1488* (2013.01); *A63B 21/1496* (2013.01); *A63B 21/4034* (2015.10); *A63B 21/4035* (2015.10); *A63B 21/4045* (2015.10); *A63B 21/4049* (2015.10); *A63B 23/0216* (2013.01); *A63B 23/1236* (2013.01); *A63B 2208/0295* (2013.01); *A63B 2210/50* (2013.01)

(58) Field of Classification Search

CPC ..... A63B 21/00
USPC ..... 482/907, 121, 126, 141
See application file for complete search history.

(56) References Cited

U.S. PATENT DOCUMENTS

| | | | | |
|---|---|---|---|---|
| 4,506,884 | A * | 3/1985 | Hankin | 482/131 |
| 4,900,015 | A | 2/1990 | Dissinger | |
| 5,205,802 | A | 4/1993 | Swisher | |
| 5,643,162 | A * | 7/1997 | Landers et al. | 482/131 |
| 6,186,930 | B1 * | 2/2001 | Ignaczak | 482/141 |
| 7,935,040 | B2 | 5/2011 | Moskowich | |
| 7,972,251 | B2 | 7/2011 | Peddar | |

* cited by examiner

*Primary Examiner* — Jerome W Donnelly
(74) *Attorney, Agent, or Firm* — Buchanan Ingersoll & Rooney PC

(57) ABSTRACT

An exercise device for performing exercises employing upper body and abdominal muscles includes a hinge and a pair of guide tracks, each guide track attached to a corresponding side of the hinge. Each guide track includes a central longitudinal slot formed in the guide track, the slot having a plurality of stop positions formed therein, a rotatable pushup handle assembly slidable over the slot between stop positions, and a locking device insertable into a portion of the rotatable pushup handle assembly to lock a lower portion of the rotatable pushup handle assembly in one of the stop positions in the slot, an upper portion of the rotatable pushup assembly still able to rotate while the assembly is in a locked condition.

22 Claims, 13 Drawing Sheets

EXERCISE DEVICE

CROSS-REFERENCE TO RELATED APPLICATION

The present application claims the benefit under 35 U.S.C. §119(e) of U.S. Provisional Patent Application No. 61/728,305 to Mills et al., filed Nov. 20, 2012, the entire contents of which is hereby incorporated by reference herein.

BACKGROUND

1. Field

Example embodiments generally relate to an exercise device for performing multiple, different exercises employing upper body and abdominal muscles.

2. Related Art

Push-ups are one of the oldest and perhaps most effective exercises for a human being. The push-up exercise is employed by the military and competitive sports teams around the world to gauge overall fitness. Conventional push-ups however, with the hands placed directly on a non-movable hard surface such as a floor, have limitations. Conventional push-ups place stress on wrists, elbows and shoulders, and prevent the natural rotation of muscles and joints.

Rotatable pushup devices have been developed to reduce stress on some of these joints and permit natural rotation of muscle groups. One well known device is the PERFECT PUSHUP® device. This device has a handle with support structure on a fixed base support attached to the handle support structure. It includes a bearing assembly to permit rotation of the contiguous handle and handle support structure by a user with the base support resting on a planar surface. The PERFECT PUSHUP permits rotational movement of the handles on the planar surface while doing push-up exercises.

SUMMARY

An example embodiment of the present invention is directed to an exercise device for performing exercises employing upper body and abdominal muscles. The device may include a hinge and a pair of guide tracks. Each guide track may be attached to a corresponding side of the hinge and further include a central longitudinal slot formed in the guide track, the slot having a plurality of stop positions formed therein, a rotatable pushup handle assembly slidable over the slot between stop positions that are formed in the slot, and a threaded locking device insertable into an underside of the rotatable pushup handle assembly to lock the rotatable pushup handle assembly in one of the stop positions in the slot, wherein a portion of the rotatable pushup assembly is still able to rotate while the assembly is in a locked condition. The device may include an elongate safety stop insertable into one or more of the formed stop positions within the slot to limit longitudinal travel of the rotatable pushup handle assembly within the slot and to serve as a backup stabilizer in case the locking device fails.

Another example embodiment is directed to an exercise device for performing exercises employing upper body and abdominal muscles. The device may include a double-sided hinge and a pair of guide tracks. Each guide track may be attached to a corresponding side of the double-sided hinge and further include a central longitudinal slot formed in the guide track, the slot having a plurality of stop positions formed therein, a deck that rides on rollers along the guide track and over the slot, a rotatable turntable secured to the deck, a platform attached to the turntable, and a pushup stand removably attached to the platform. The deck with rotatable turntable, platform and pushup stand thereon may be slidable on the guide track and along the slot between stop positions. The device may include a locking device configured to lock the deck in one of the stop positions, the platform with pushup stand still able to rotate while the deck is in a locked condition.

Another example embodiment is directed to an exercise device which may include a pair of connected guide tracks, each track further including a slot formed therein, and a rotatable pushup handle assembly slidable along the slot. Each assembly may further include a deck that rides on rollers in the slot, a rotatable turntable attached to the deck, a platform attached to the turntable, and a pushup stand removably attached to the platform. The device may include a locking device configured to lock the rotatable pushup handle assembly in the slot, a portion of the rotatable pushup handle assembly still able to rotate while in a locked condition.

BRIEF DESCRIPTION OF THE DRAWINGS

Example embodiments will become more fully understood from the detailed description given herein below and the accompanying drawings, wherein like elements are represented by like reference numerals, which are given by way of illustration only and thus are not limitative of the example embodiments herein.

DETAILED DESCRIPTION

As to be described hereafter, an example embodiment is directed to an exercise device with rotatable, laterally movable pushup stands within a guided track, the stand separately removable from the device. In a variant, the device is hingeable or pivotable from vertical at a central location thereof to permit instability to be added to exercise.

Figure 1:
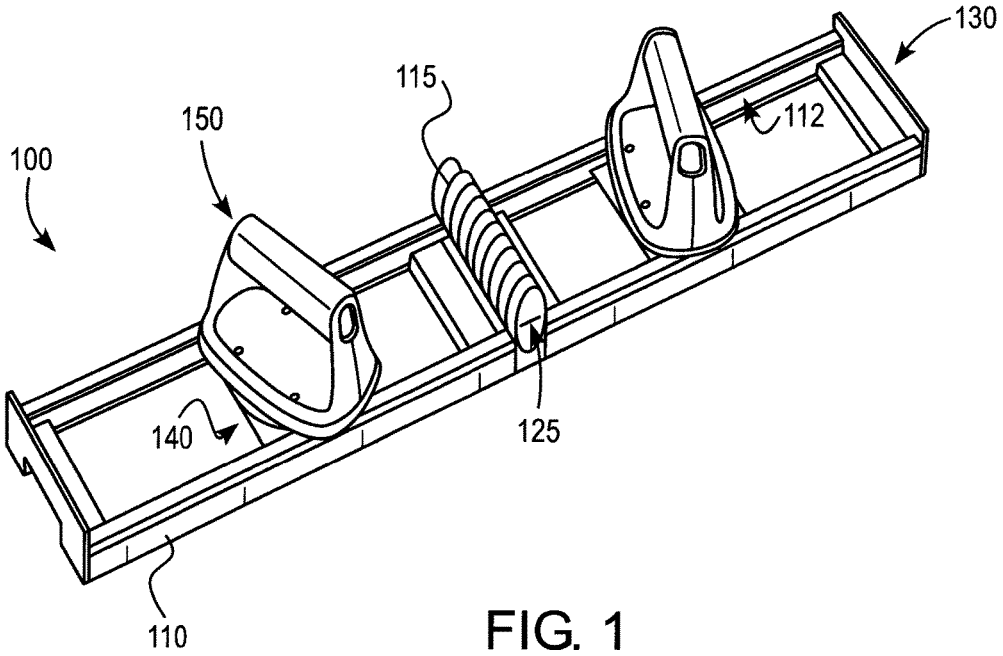
FIG. 1 is a front perspective view of an exercise device in a first orientation according to an example embodiment.
Figure 2:
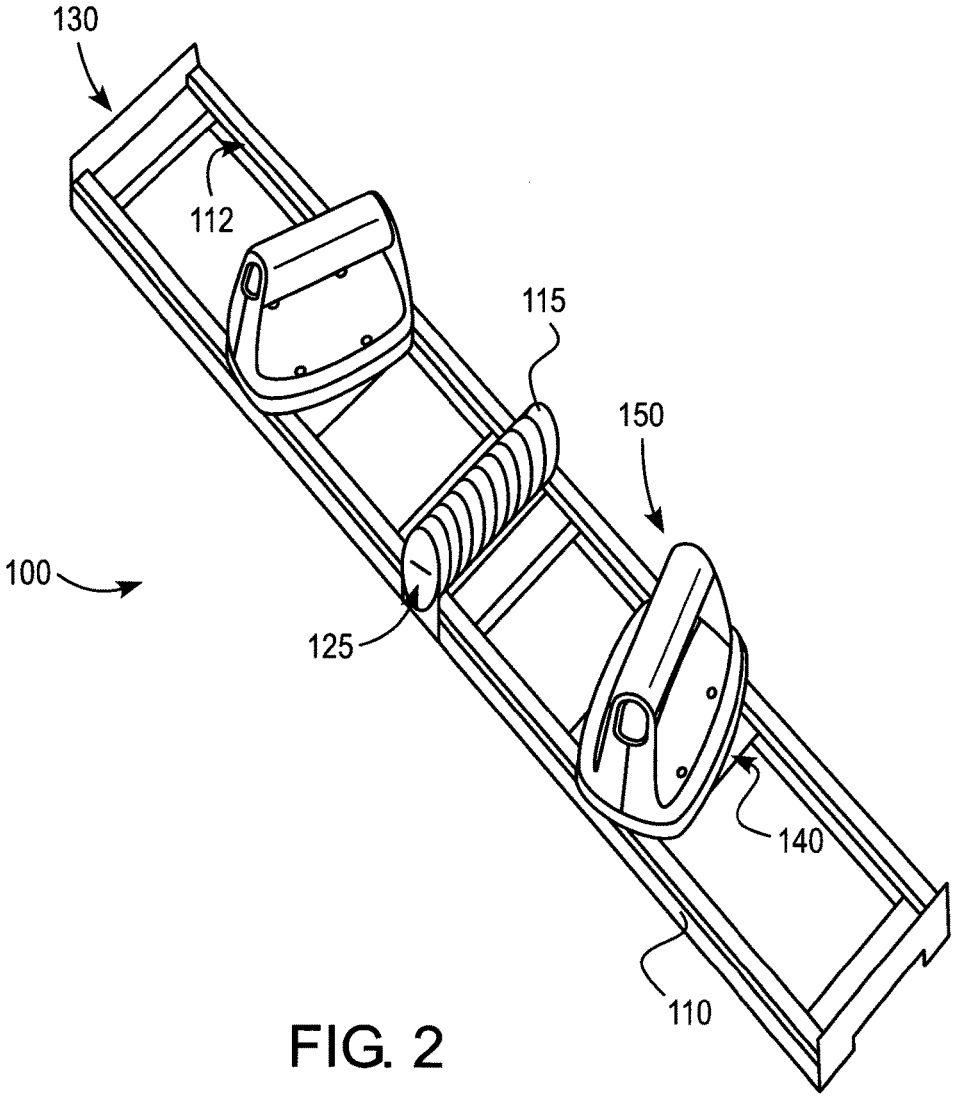
FIG. 2 is a front perspective view of the exercise device in a second orientation

FIG. 1 is a front perspective view of an exercise device in a first orientation according to an example embodiment; FIG. 2 is a front perspective view of the exercise device in a second orientation; and FIG. 3 is an exploded parts view of the exercise device shown in FIGS. 1 and 2.

Figure 3:
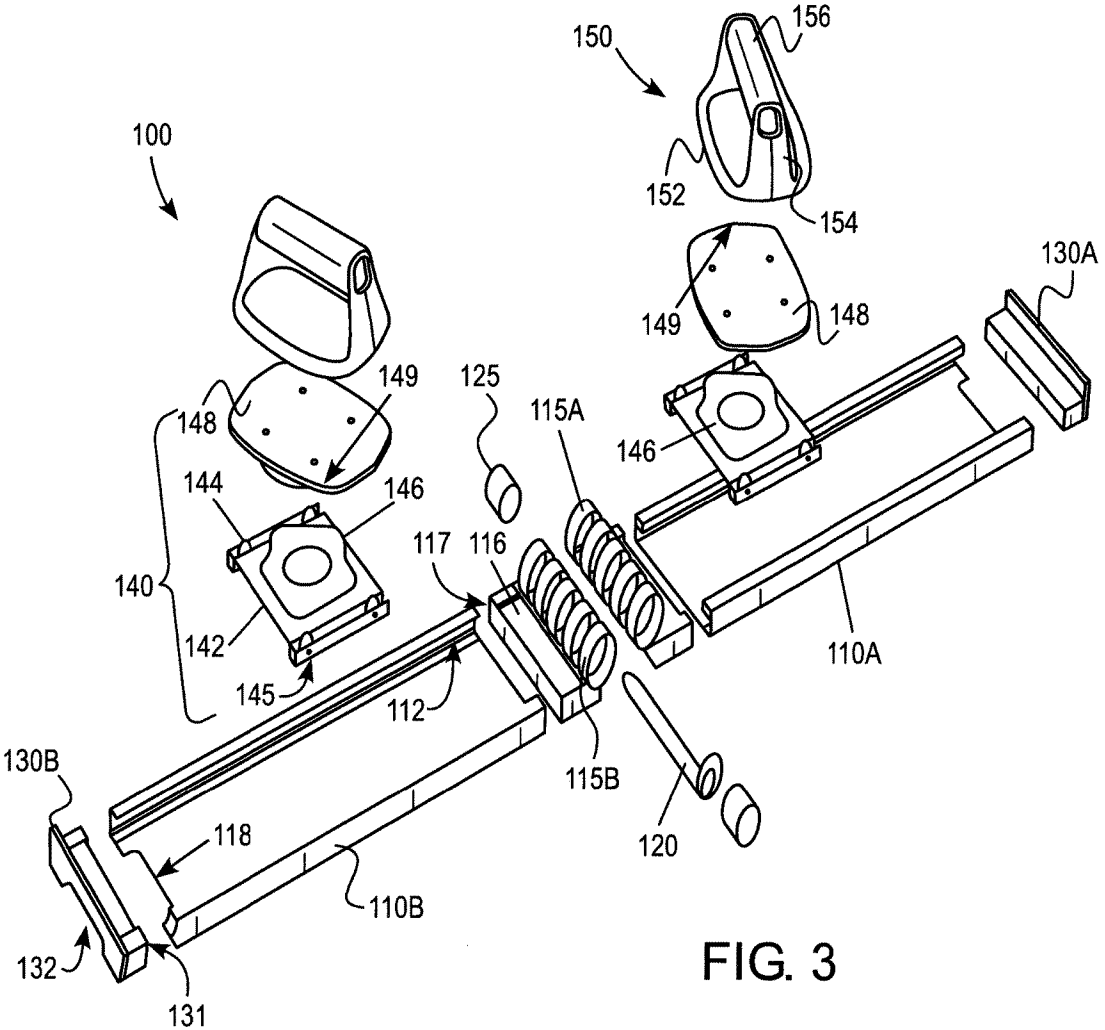
FIG. 3 is an exploded parts view of the exercise device shown in FIGS. 1 and 2.

Referring to FIGS. 1-3, exercise device 100 includes a track 100 comprised of track parts 110A and 110B secured together by a central hinge 115. The central hinge 115 comprises hinge parts 115A and 115B that couple together and are secured thereto via a hinge tube 120 between end caps 125.

Each pushup stand 150 is removable from its corresponding sliding and rotating assembly 140, such that one could perform exercises with the stands 150 separately from device 100. The pushup stand includes a base 152, a pair of upstanding arms 154 extending from base 152 and having a handle 156 mounted between the arms 154. The pushup stand 150 could be formed of one piece injection molding or connected as two halves, for example. The handle 156 could include a rubber overmold grip thereon to facilitate grasping.

Each hinge part 115A, 115B has a base 116 which couples to the grooved channels 112 in a corresponding track part 110A, 110B via feet 117, for an interference friction fit. Similarly handle 130 is formed as two handle parts 130A, 130B which has a base 131 with feet 132 that friction fit into the channels 112 at ends of the track parts 110A, 110B.

The sliding and rotating assembly 140 includes a deck 142 with a plurality or rollers 144 at corners thereof that ride on axles 145. The rollers 144 engage the channels 112 in the track 110. A rotatable turntable 146 is mounted on the deck 142 and secured thereto by fasteners (not shown). A platform 148 is mounted on the turntable 146 and affixed thereto by fasteners (not shown) which couple holes formed into the platform 148 with aligned capture bores in the corners of the turntable 146.

Each removable pushup stand 150 is mounted on a corresponding platform 148. The platform 148 has a retaining lip 149 around an outer circumference thereof, so that when the stand 150 is placed on the platform 148, the base 152 engages the lip 149 in press fit/interference fit fashion, securing the stand 150 in place on the rotatable platform 148.

The pushup stands 150 may be formed by injection molding from a plastic with thermoplastic resin with rubber over-mold handles/tread thereon. The track 110 is made of metal such as aluminum or spring steel. The hinge 115 is made of plastic and/or metal, the deck 142 is made of plastic and/or metal, and the turntable 146 is made of metal with a series of bearings, or of a low friction plastic with metal bearings. Platform 148 is composed of plastic and/or metal.

In use, one example being a user grasping the stands 150 on the device 100 in pushup position, the user can move their arms in an out laterally during a pushup exercise, as the sliding and rotating assembly 140 moves back and forth along the channels 112 in track 110, with the rollers 144 engaging the channels 112.

In a variant, resistance bands or bungee type cords could be connected between deck 142 and one or both bases 116, 131 to add additional resistance. In a further variant, since the hinge allows 180 degree angular movement of one of the track parts 110A and/or 110B, an object could be placed under hinge 115 to add instability during exercise.

Figure 4:
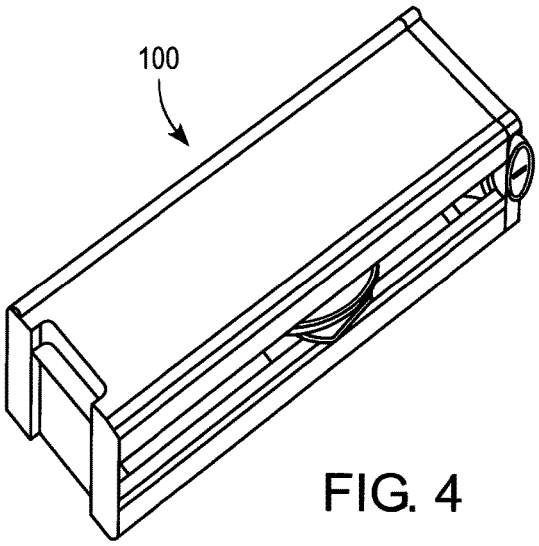
FIG. 4 is a perspective view of the exercise device in a stowed configuration, in a first orientation.
Figure 5:
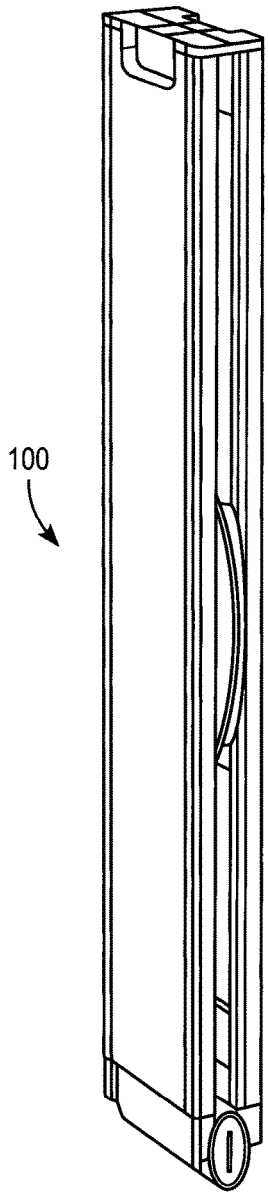
FIG. 5 is a perspective view of the exercise device in a stowed configuration, in a second orientation.

FIG. 4 is a perspective view of the exercise device in a stowed configuration, in a first orientation; and FIG. 5 is a perspective view of the exercise device in a stowed configuration, in a second orientation. FIGS. 4 and 5 illustrate the 180 degree movement of the track parts 110A, 110B about hinge 115. As such, when not in use, to store or to orient for transport, the two track parts 110A/B are rotated about hinge so as to meet, forming handle 130 out of handle parts 130A/B (FIG. 3 shows recesses 118 to provide finger clearance for handle 130). Accordingly, with the stands 150 removed, the supports 148 abut one another and the device 100 is configured into a compact orientation for stowage or travel.

Device 100 may be employed by a user to perform a number of different exercises. Example exercises include, but are not limited to wide, regular, close (narrow) pushups; flies such as modified single-arm fly and straight-arm fly, mountain climbers, horizontal knee ups, etc. Each track part 110A/B can be separately removed from the hinge 115 to facilitate performing one-armed exercises such as a mountain climber or one-armed pushup. Accordingly, the two tracks 110A/B can be decoupled from each other by taking apart the hinge 115, such that the tracks can be used separately.

Figure 6:
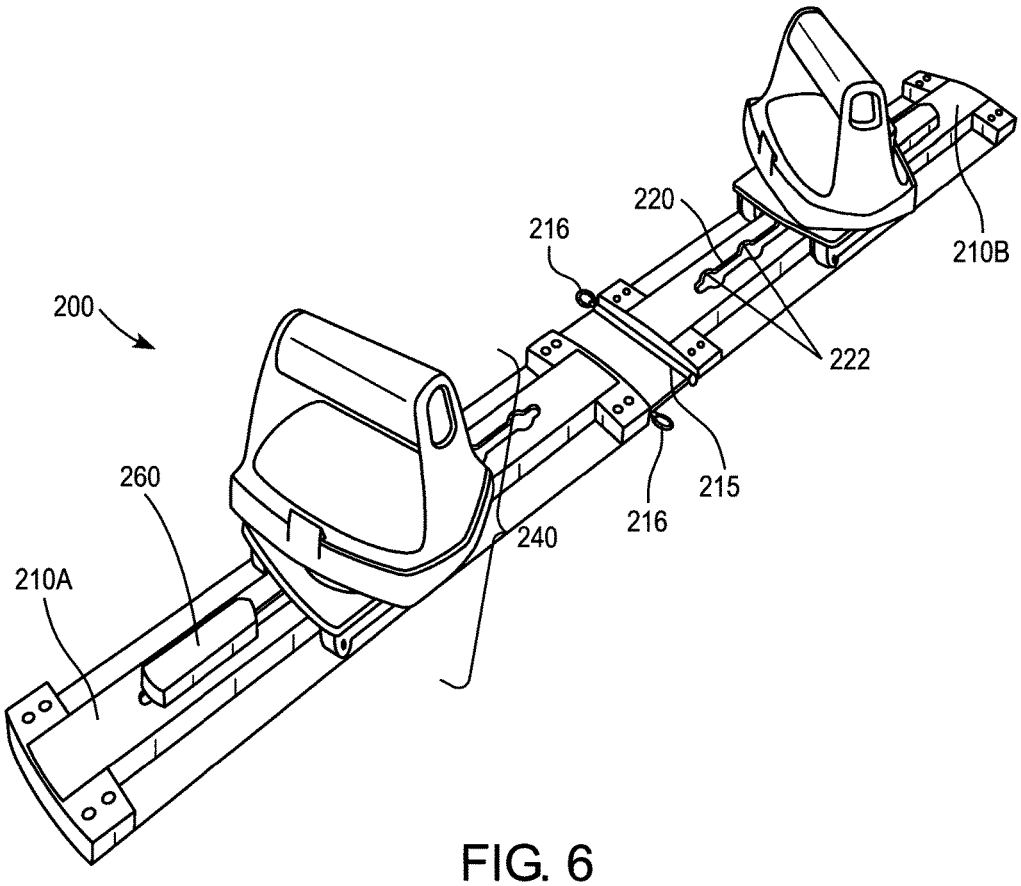
FIG. 6 is a perspective view of an exercise device in another example embodiment.
Figure 7:
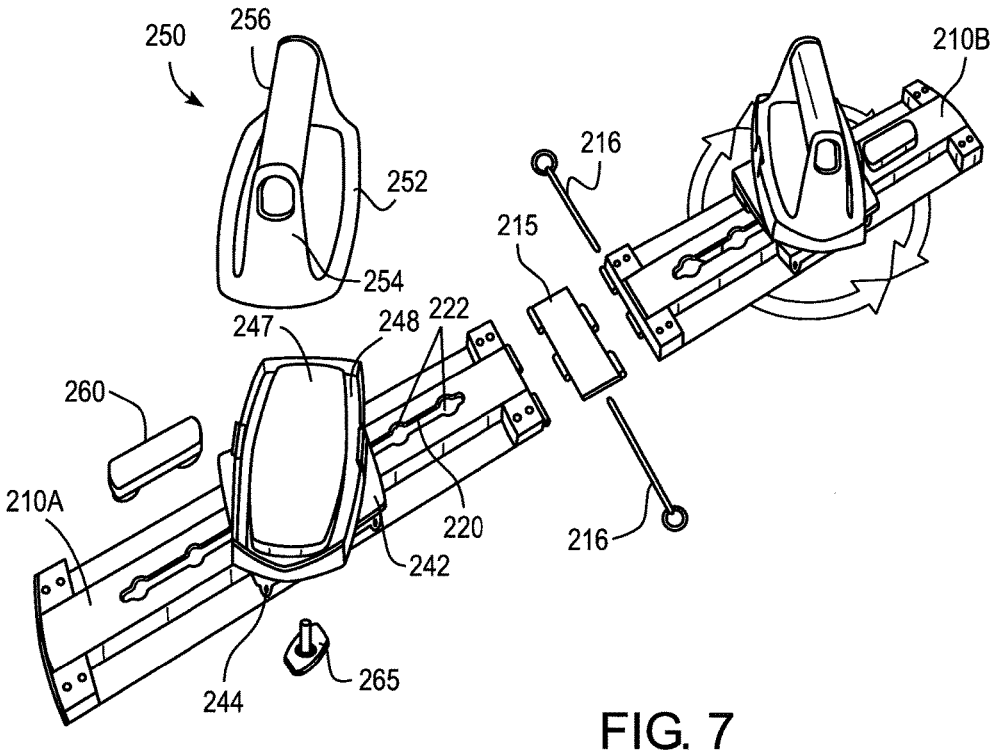
FIG. 7 is an exploded parts view of the device of FIG. 6.
Figure 8:
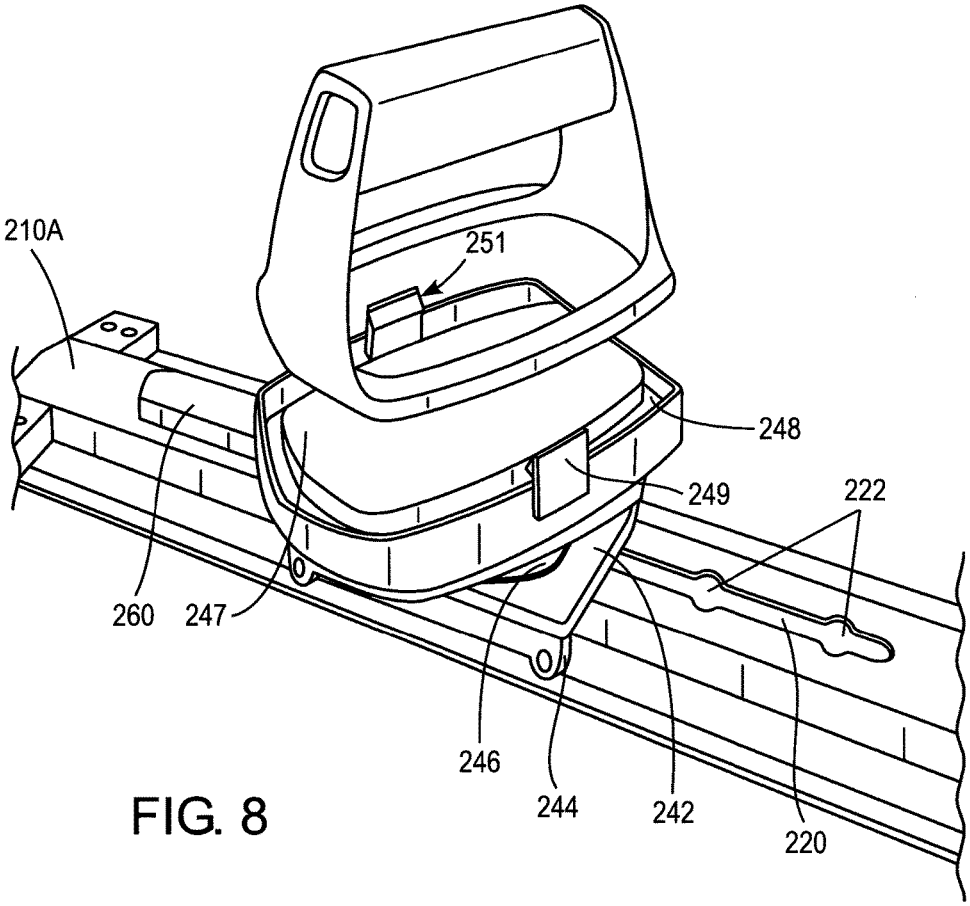
FIG. 8 is an enlarged view of one of the rotatable pushup handle assemblies.
Figure 9:
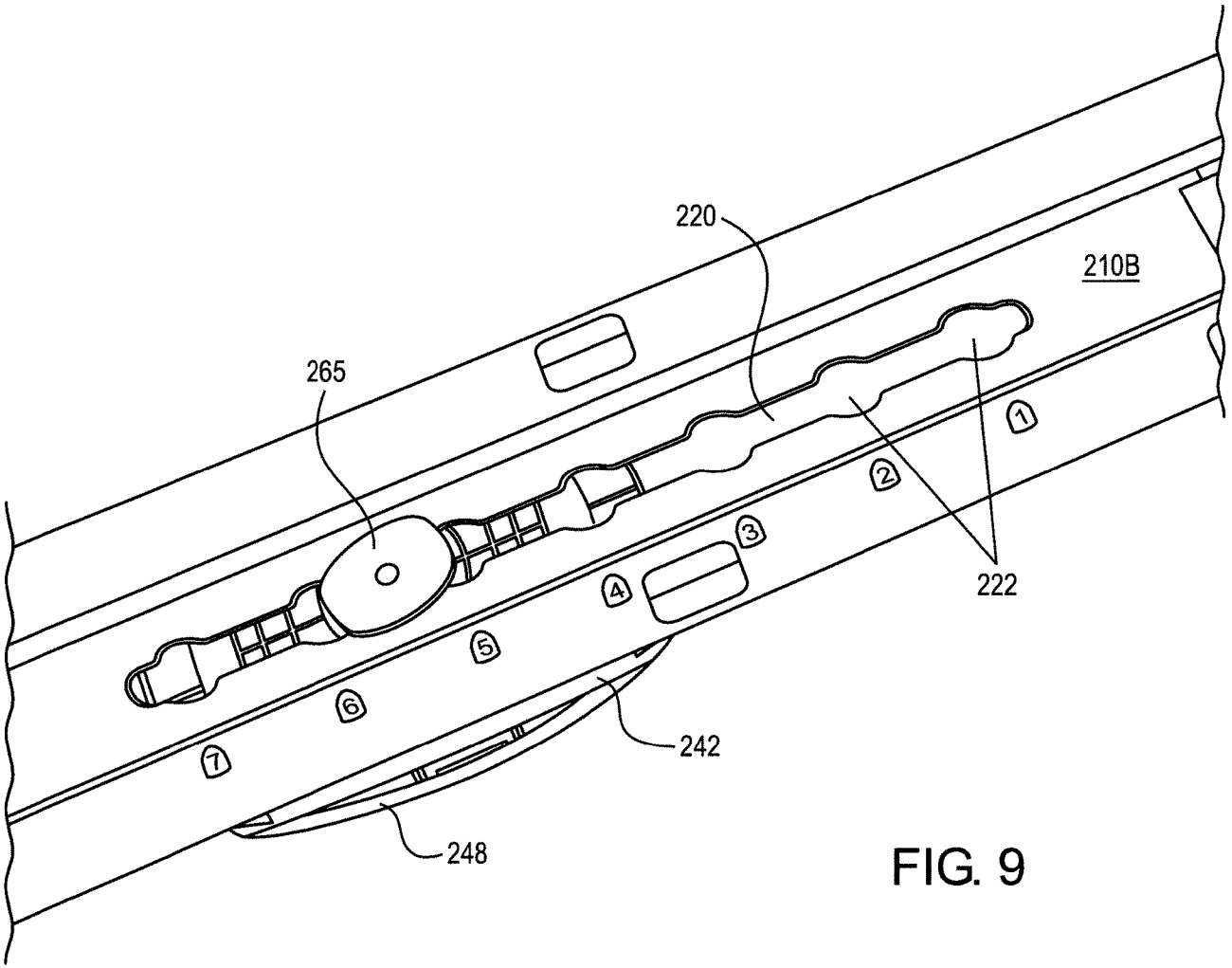
FIG. 9 is a bottom view of one of the guide tracks to show stop positions and a locking device according to the example embodiment.

FIG. 6 is a perspective view of an exercise device in an another example embodiment; FIG. 7 is an exploded parts view of the device of FIG. 6, FIG. 8 is an enlarged view of one of the rotatable pushup handle assemblies, and FIG. 9 is a bottom view of one of the guide tracks to show stop positions and a locking device according to the example embodiment. Referring to FIGS. 6 through 9, there is shown an exercise device 200 for performing exercises employing upper body and abdominal muscles. Device 200 includes a central double-sided hinge 215, and a pair of guide tracks 210A, 210B, each guide track attached to a corresponding side of the double-sided hinge 215 by a removable pin 216. As will be seen hereafter, the guide tracks 210A/210B may be separated from the hinge 215 by removing the pins 216; this will allow exercises employing the feet on device 200 to be performed.

Each guide track 210A, 210B is embodied as a central upstanding rail that extends longitudinally across a planar surface. Each guide track 210A, 210B includes a central longitudinal slot 220 formed in the guide track 210A/210B, the slot 220 having a plurality of stop positions 222 formed therein. The stop positions are shown by circular punch-outs in slot 220. There is provided a rotatable pushup handle assembly 240 on the guide track 210A/210B, slidable over the slot 220 between stop positions 222, and a removable locking device 265 insertable from beneath the guide track 210A/210B (See FIGS. 7 and 9) into a portion of the rotatable pushup handle assembly 240 to lock the rotatable pushup handle assembly 240 in one of the stop positions 222 in the slot. The rotatable pushup handle assembly 240 is still able to rotate in place while in a locked condition on guide track 210A/210B (see circular arrows in FIG. 7 for example). Each guide track 210A/210B further includes a safety stop 260 insertable into the slot 220 to limit longitudinal travel of the rotatable pushup handle assembly 240 over the slot 220. The safety stop 260 prevents a user from essentially doing the "splits" while grasping the two pushup stands 250 of the rotatable pushup handle assemblies 240, and serves as a backup stabilizer in case the locking device 265 fails. The stop positions allow the handle assemblies 240 to be variable width apart from one another; there are seven (7) stop positions included per guide track 210A/210B. The safety stops 260 are always used once a rotatable pushup handle assembly 240 is locked by the removable locking device 265, which is a threaded element that is inserted into the underside of the device 200 as shown in FIG. 9.

Each rotatable pushup handle assembly 240 includes a deck 242 on rollers 244 which enable the deck 242 to slide along the guide track 210A/210B over slot 220. Similar to the first embodiment, there is a rotatable turntable 246 (only partially shown in FIG. 8 and obscured in other figures by platform 248) affixed on top of deck 242, with a platform 248 attached on top of the turntable 246 (enabling platform 248 to rotate). A pushup stand 250 is removably attached to platform 248 by flexible clips 249. Each clip 249 has a flexible upstanding portion extending from side surfaces of the platform 248 and includes a catch 251. The pushup stand 250 is comprised of a base 252, arms 254 and handle 256; the catches 251 of each clip 249 grasp base 252 as the pushup stand 250 is placed on platform 248. The locking clips 249 are bendable by thumb pressure to disengage the catches 251 from base 252 and thus release the pushup stand 250 from the platform 248.

The locking device 265 threadingly engages a threaded bore in the deck 242 (from beneath the guide track (FIG. 9)) so as to lock a contiguous rotatable pushup handle assembly 240 in place, although the platform 248 with pushup stand 250 remains freely rotatable (i.e., still spins) via the turntable 246 on the locked-in-place deck 242. The locking device 265 is used with most exercises once the rotatable pushup handle assembly 240 is in the desired lock position(s) 222 within slot 220. Before or after the rotatable pushup handle assembly 240 is locked in place, the safety stops 260 are inserted into the slot. The safety stops 260 take up two (2) lock positions 222 within slot.

The platform 248 includes a pad 247 on an upper planar surface thereof for use of the platform 248 without the pushup stand 250 attached. For example, if a user decides to perform a punch-up exercise (pushups on fists), he would remove the pushup stands 250 and center his fists in the middle of pads 247, once the deck 242 is locked in position with the platform 248 with pad 247 freely rotatable.

Similar to FIGS. 4 and 5, and although not shown, when not in use, to store device 200 or to orient it for transport, the two guide tracks 210A/B are rotated about hinge 215 so as to meet. Accordingly, with the pushup stands 250 removed and the device 200 folded, the platforms 248 would abut one another as the device 200 is configured into a compact, folded orientation for stowage or travel.

Figure 10:
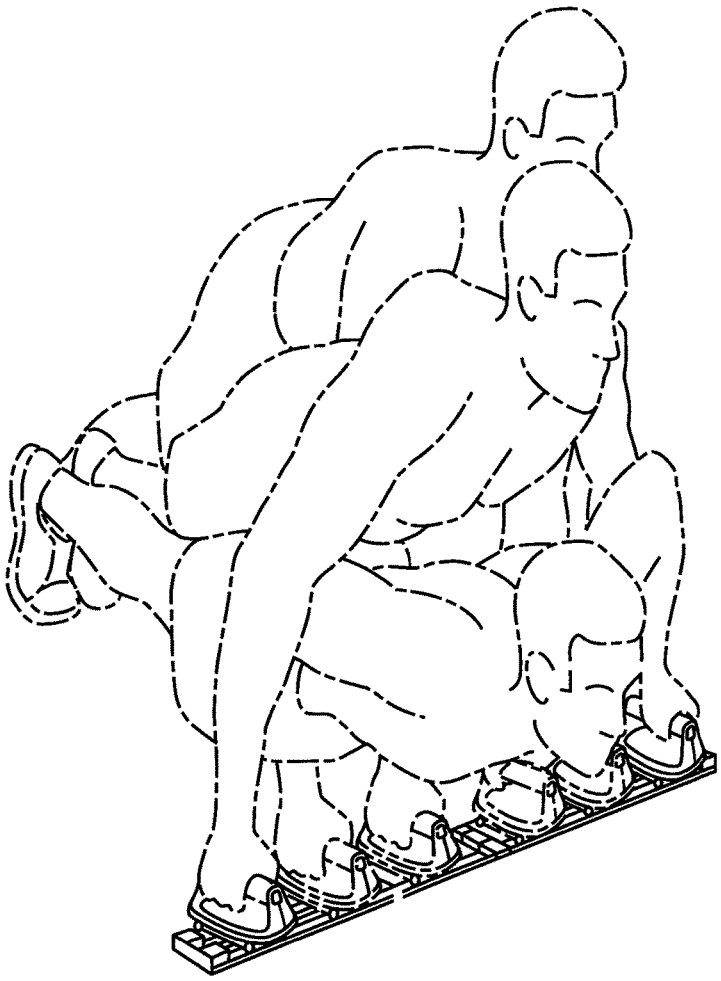
FIG. 10 is a rendering of a user using the exercise device in each of regular, close-in and extended pushup positions.
Figure 11A:
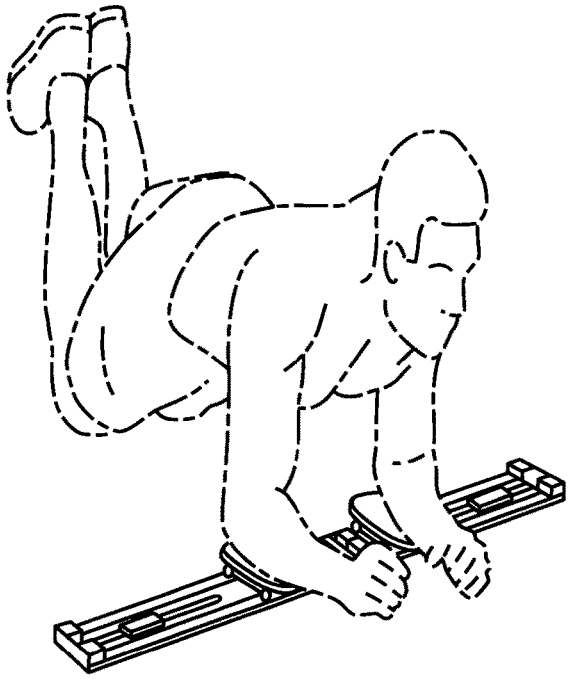
FIGS. 11A and 11B show a modified forearm fly exercise using the exercise device.
Figure 11B:
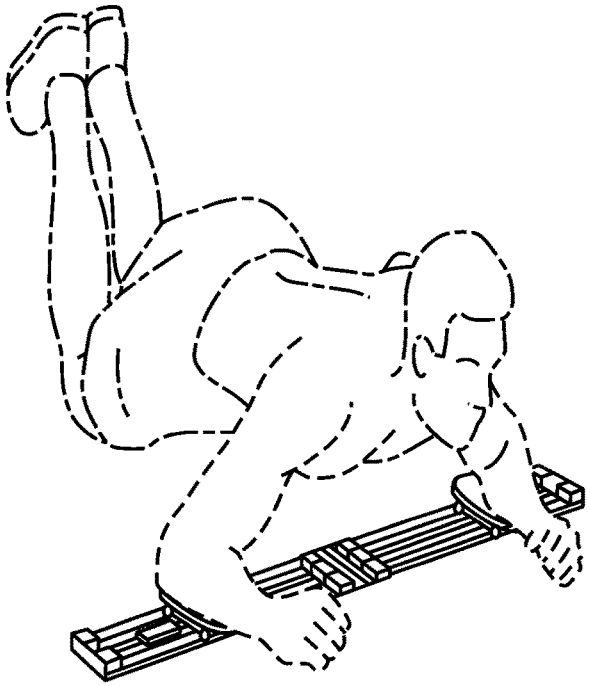
Figure 12A:
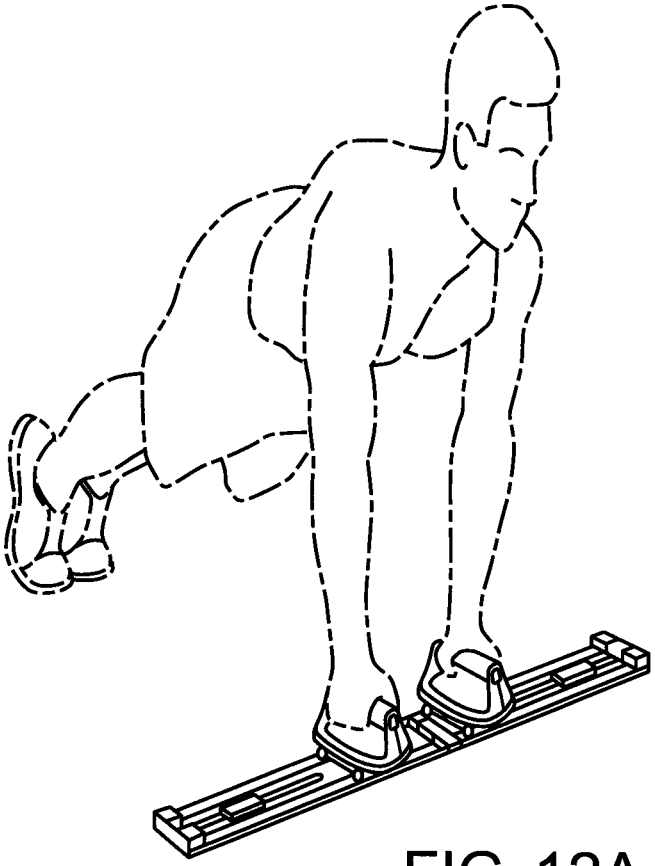
FIGS. 12A and 12B show a non-rotating body weight fly exercise using the exercise device.
Figure 12B:
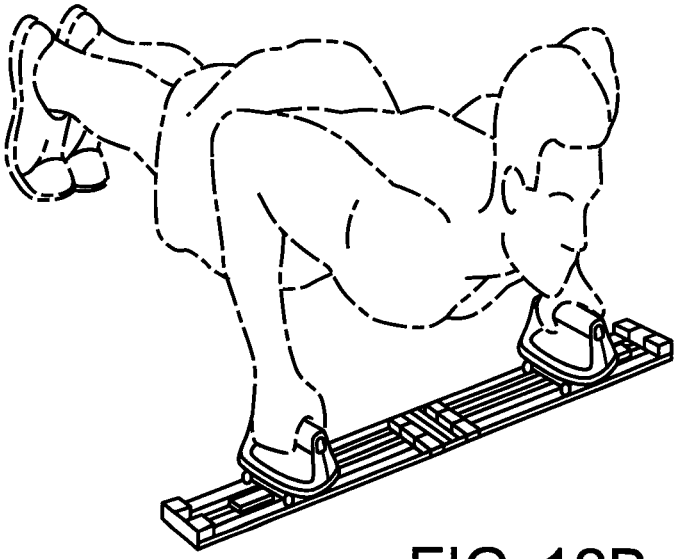
Figure 13:
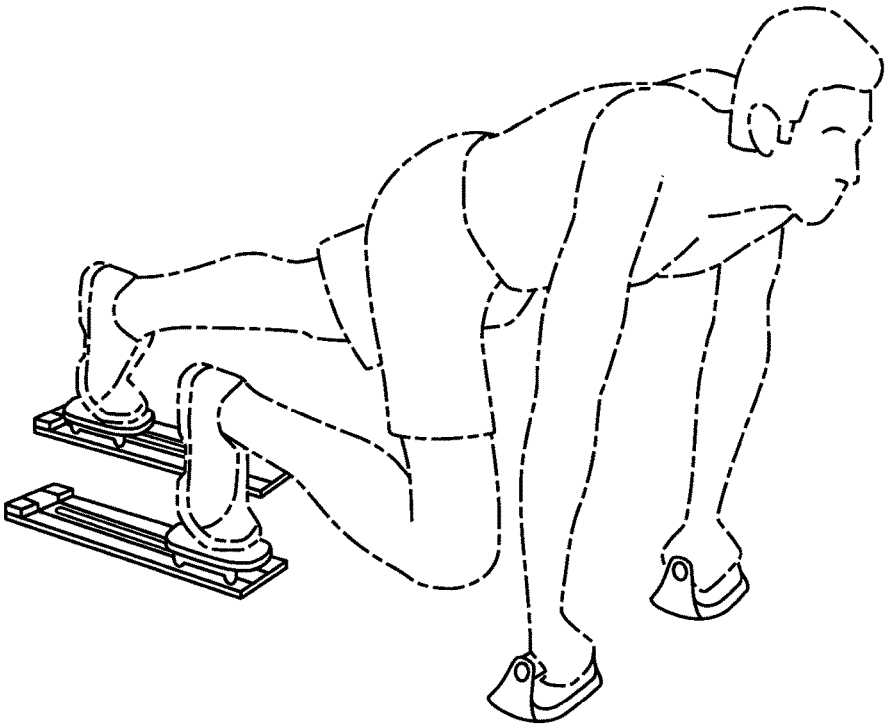
FIG. 13 shows a mountain climber exercise using the exercise device.
Figure 14A:
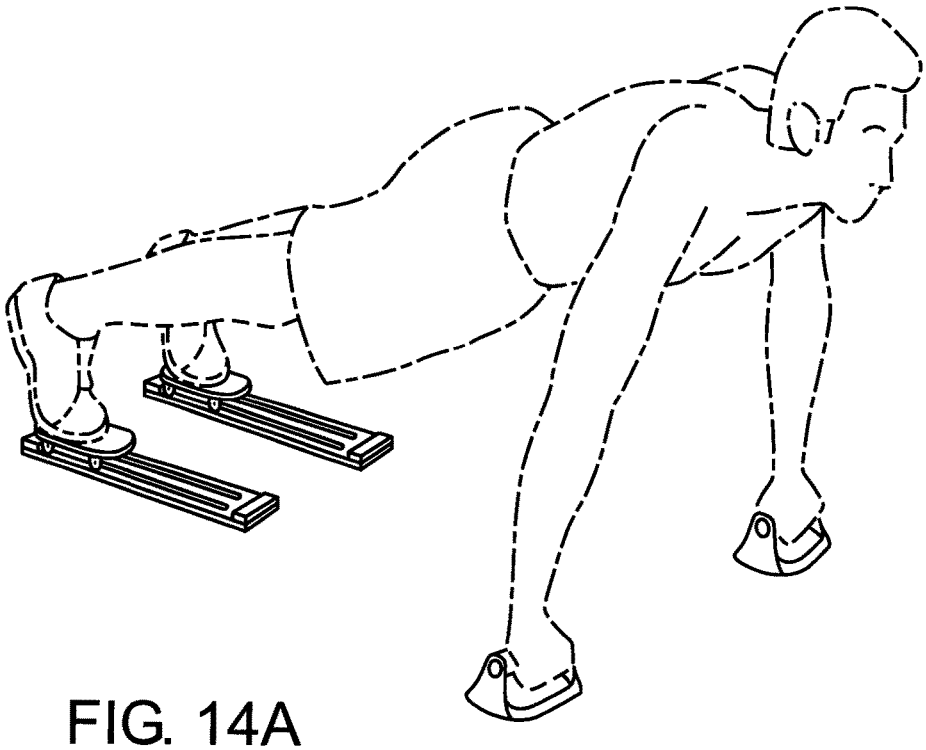
FIGS. 14A and 14B show a squat thrust exercise using the exercise device.
Figure 14B:
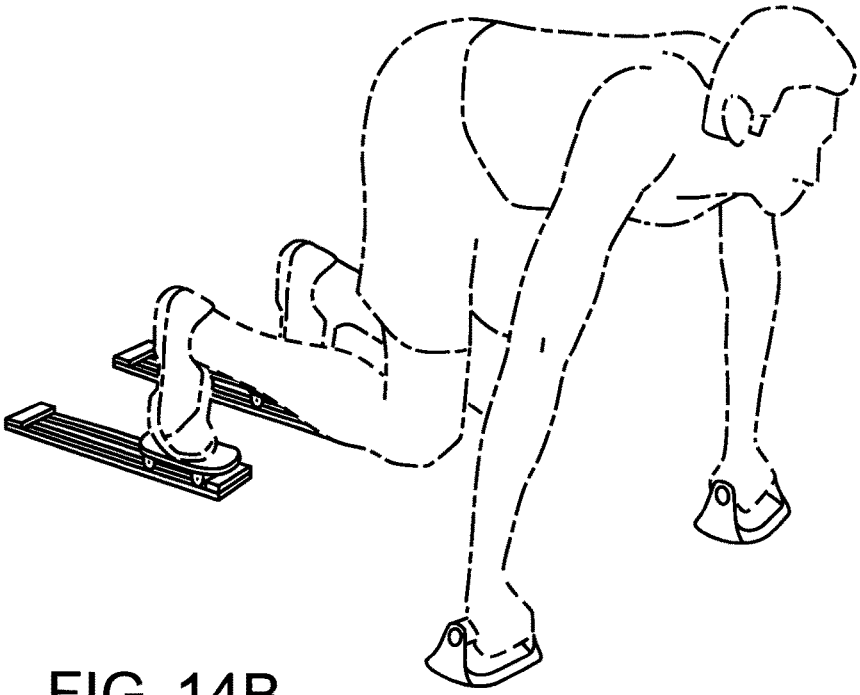

FIGS. 10 through 14B show various additional example exercises that can be performed with exercise device 200, although the device 200 is not so limited for use to perform only these exercises; other exercises may be performed. FIG. 10 is a rendering of a user using the exercise device 200 in each of regular, close-in and extended pushup positions, with hands grasping the pushup stands 250 secured in their respective platforms 248. Of note in FIG. 10 the safety stops 260 are not shown, but would be used for the close-in and regular pushup positions; for extended pushup positions the user would insert the safety stops 260 into slot 220 on the inner side of the assemblies 240 as the rotatable pushup assemblies 240 would be locked in the outermost stop positions against the ends of the guide track 210A/B. FIGS. 11A and 11B show a modified forearm fly exercise, with the stands 250 removed so that the forearms may be positioned on pads 247. FIGS. 12A and 12B show a non-rotating body weight fly exercise. Here, each rotatable pushup handle assembly 240 remains unlocked, with the safety stops 260 being inserted into slot 220 to limit travel and prevent the user from doing the splits on the guide tracks 210A/210B. FIGS. 13 and 14A/B show use of the device 200 in an uncoupled condition with the pins 216 having been removed to separate the guide tracks 210A/B from the doubled-sided hinge 215. In FIG. 13, the user is performing a mountain climber exercise, with feet on the pads 247 and hands on pushup stands 250 which have been removed from the platforms 248. FIGS. 14A and 14B show a squat thrust exercise using the uncoupled guide tracks 210A/B with the feet, and hands on removed pushup stands 250. The safety stops 260 are not used for the mountain climber and squat thrust exercises.

The example embodiments being thus described, it will be obvious that the same may be varied in many ways. Such variations are not to be regarded as departure from the example embodiments, and all such modifications as would be obvious to one skilled in the art are intended to be included herein.

We claim:

1. An exercise device for performing exercises employing upper body and abdominal muscles, comprising:
- a hinge,
- a pair of guide tracks, each guide track attached to a corresponding side of the hinge, each guide track including:
  - a central longitudinal slot formed in the guide track, the slot having a plurality of stop positions formed therein,
  - a rotatable pushup handle assembly slidable over the slot between stop positions formed in the slot, and
  - a threaded locking device insertable into an underside of the rotatable pushup handle assembly to lock the rotatable pushup handle assembly in one of the stop positions in the slot, wherein a portion of the rotatable pushup assembly is still able to rotate while the assembly is in a locked condition, and
  - an elongate safety stop insertable into one or more of the formed stop positions within the slot to limit longitudinal travel of the rotatable pushup handle assembly within the slot and to serve as a backup stabilizer in case the locking device fails.

2. An exercise device for performing exercises employing upper body and abdominal muscles, comprising:
- a double-sided hinge,
- a pair of guide tracks, each guide track attached to a corresponding side of the double-sided hinge, each guide track including:
  - a central longitudinal slot formed in the guide track, the slot having a plurality of stop positions formed therein,
  - a deck that rides on rollers along the guide track and over the slot, a rotatable turntable secured to the deck, a platform attached to the turntable, and
  - a pushup stand removably attached to the platform, the deck with rotatable turntable, platform and pushup stand thereon slidable on the guide track and along the slot between stop positions, and
  - a locking device configured to lock the deck in one of the stop positions, the platform with pushup stand still able to rotate while the deck is in a locked condition.

3. The device of claim 2, further comprising a pair of removable pins for securing the guide tracks to the double-sided hinge.

4. The device of claim 2, wherein the platform includes a pair of locking clips extending up from side surfaces of the platform for retaining the pushup stand thereon, the locking clips bendable by thumb pressure to release the pushup stand from the platform.

5. The device of claim 2, wherein the platform includes a pad on an upper planar surface thereof for engaging hands on the platform without the pushup stand attached.

6. The device of claim 2, wherein each guide track has seven stop positions formed in the slot so that a space between rotatable pushup handle assemblies on the guide tracks is variable.

7. The device of claim 2, wherein each guide track further includes a safety stop insertable into the slot of the guide track to limit longitudinal travel of the deck with turntable, platform and pushup stand thereon over the slot.

8. The device of claim 7, wherein each deck with turntable, platform and pushup stand thereon is freely slidable over its corresponding slot with the locking device disengaged and safety stops removed from the slots.

9. The device of claim 2, wherein the device is configured to be engaged by a user with hands on the pushup stands secured in the platforms to perform pushup and fly exercises.

10. The device of claim 5, the device is configured to be engaged by a user with feet on the pads with the two guide tracks separated from the hinge, and hands on pushup stands which have been removed from the platforms to perform mountain climber and squat thrust exercises.

11. An exercise device, comprising:

a pair of connected guide tracks, each including:

a slot formed therein, a rotatable pushup handle assembly slidable along the slot, each assembly further including:

a deck that rides on rollers in the slot, a rotatable turntable attached to the deck, a platform attached to the turntable, and a pushup stand removably attached to the platform, and a locking device configured to lock the rotatable pushup handle assembly in the slot, a portion of the rotatable pushup handle assembly still able to rotate while in a locked condition.

12. The device of claim 11, wherein the slot includes a plurality of stop positions formed therein.

13. The device of claim 12, wherein the locking device is configured to lock the rotatable pushup handle assembly in one of the stop positions in the slot.

14. The device of claim 11, wherein each guide track is connected to a central hinge.

15. The device of claim 14, further comprising a pair of removable pins for securing the guide tracks to the hinge.

16. The device of claim 11, wherein the platform includes a pair of locking clips extending up from side surfaces of the platform for retaining the pushup stand thereon, the locking clips bendable by thumb pressure to release the pushup stand from the platform.

17. The device of claim 11, wherein the platform includes a pad on an upper planar surface thereof for engaging hands on the platform without the pushup stand attached.

18. The device of claim 17, wherein the device is configured to be engaged by a user with feet on the pads with the two guide tracks separated from the hinge, and hands on pushup stands which have been removed from the platforms to perform mountain climber and squat thrust exercises.

19. The device of claim 11, wherein each guide track has seven stop positions formed in the slot so that a space between rotatable pushup handle assemblies on the guide tracks is variable.

20. The device of claim 11, wherein the locking device is insertable beneath the guide track and up through the slot into the portion of the rotatable pushup handle assembly so as to lock the rotatable pushup handle assembly in one of the stop positions in the slot.

21. The device of claim 11, wherein the device is configured to be engaged by a user with hands on the pushup stands secured in the platforms to perform pushup and fly exercises.

22. The device of claim 14, wherein the hinge is a double-sided hinge.

* * * * *